US010557292B2

(12) United States Patent
Machida et al.

(10) Patent No.: US 10,557,292 B2
(45) Date of Patent: Feb. 11, 2020

(54) DOOR CLOSER DEVICE FOR VEHICLE

(71) Applicant: AISIN SEIKI KABUSHIKI KAISHA, Kariya-shi (JP)

(72) Inventors: Toshio Machida, Toyota (JP); Satoshi Shibayama, Nagoya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 1202 days.

(21) Appl. No.: 14/809,788

(22) Filed: Jul. 27, 2015

(65) Prior Publication Data

US 2016/0032630 A1 Feb. 4, 2016

(30) Foreign Application Priority Data

Jul. 30, 2014 (JP) ..... 2014-154587

(51) Int. Cl.
*E05B 81/20* (2014.01)

(52) U.S. Cl.
CPC ..... *E05B 81/20* (2013.01)

(58) Field of Classification Search
CPC ..... E05B 81/20; E05B 81/21; E05B 83/40; Y10T 292/1047; Y10T 292/1082; Y10T 292/1078; Y10S 292/23
USPC ..... 49/279, 280, 281, 360; 296/155
See application file for complete search history.

(56) References Cited

U.S. PATENT DOCUMENTS 6,131,337 A 10/2000 Machida
7,360,337 B2 4/2008 Yoneyama
8,061,742 B2 * 11/2011 Machida ..... E05B 81/20 292/201
8,894,104 B2 * 11/2014 Yokomori ..... E05B 81/20 292/199
9,328,540 B2 * 5/2016 Yokomori ..... E05B 83/40
(Continued)

FOREIGN PATENT DOCUMENTS

JP 11-303483 11/1999
JP 2005-139790 6/2005
JP 2014-9477 A 1/2014

OTHER PUBLICATIONS

Office Action dated Apr. 4, 2018 in Japanese Patent Application No. 2014-154587 (with English language translation).

*Primary Examiner* — Alyson M Merlino
(74) *Attorney, Agent, or Firm* — Oblon, McClelland, Maier & Neustadt, L.L.P.

(57) ABSTRACT

A door closer device for a vehicle includes a latch, a drive force transmission mechanism and a cancellation mechanism cancelling a closing operation of the drive force transmission mechanism. The drive force transmission mechanism includes a drive force transmission portion rotatable between a transmission position where the latch is configured to receive a drive force of an actuator and a non-transmission position where the latch is configured not to receive the drive force of the actuator. The cancellation mechanism includes a first operation portion and a second operation portion, the first operation portion engaged with the drive force transmission portion to be rotated irrespective of the second operation portion, the second operation portion engaged with the drive force transmission portion to be rotated irrespective of the first operation portion, the first and second operation portions rotating the drive force transmission portion from the transmission position to the non-transmission position.

7 Claims, 10 Drawing Sheets

(56) References Cited

U.S. PATENT DOCUMENTS

| | | | | |
|---|---|---|---|---|
| 2009/0267359 | A1* | 10/2009 | Takayanagi | E05B 81/20 292/201 |
| 2012/0056437 | A1* | 3/2012 | Takayanagi | E05B 83/40 292/118 |
| 2014/0000169 | A1* | 1/2014 | Yokomori | E05B 81/20 49/349 |
| 2014/0001771 | A1* | 1/2014 | Shibayama | E05B 81/20 292/100 |
| 2014/0070549 | A1* | 3/2014 | Hanaki | E05B 81/20 292/200 |
| 2014/0319847 | A1* | 10/2014 | Uehara | E05B 81/20 292/97 |
| 2016/0010364 | A1* | 1/2016 | Hanaki | E05B 81/20 292/21 |
| 2016/0010365 | A1* | 1/2016 | Hanaki | E05B 81/14 292/21 |

* cited by examiner

DOOR CLOSER DEVICE FOR VEHICLE

CROSS REFERENCE TO RELATED APPLICATIONS

This application is based on and claims priority under 35 U.S.C. § 119 to Japanese Patent Application 2014-154587, filed on Jul. 30, 2014, the entire content of which is incorporated herein by reference.

TECHNICAL FIELD

This disclosure generally relates to a door closer device for a vehicle, the door closer device being mounted to a door of the vehicle.

BACKGROUND DISCUSSION

An example of a known door closer device for a vehicle (hereinafter also referred to as a door closer device) is disclosed in JP2005-139790A (hereinafter referred to as Patent reference 1). According to Patent reference 1, the door closer device includes a cancellation mechanism that cancels a closing operation of a door of the vehicle by a door-opening operation of an operation handle while performing a closing operation that sets the door of the vehicle being in a half-open state to be in a fully-closed state. In particular, according to the construction of the door closer device, in a state where a latch is in a half-latched position where the latch is incompletely engaged with a striker that is provided at a vehicle body, the closing operation of the door of the vehicle is performed by the transmission of a drive force of a latch drive motor configuring an actuator to the latch via a sector gear, a cancellation lever, a first close lever and a second close lever, the closing operation switching the position of the latch from the half-latched position to a fully-latched position. Meanwhile, the cancellation mechanism is provided with a fail-safe lever that is driven by the door-opening operation of the operation handle and that is driven to release the engagement of the sector gear and the cancellation lever. According to the cancellation mechanism, when the fail-safe lever is driven, the closing operation of the door of the vehicle is cancelled because the drive force of the latch drive motor comes to be not transmitted to the cancellation lever. Accordingly, the switching of the latch to the fully-latched position is suspended.

Meanwhile, according to the door closer device disclosed in Patent reference 1, the simplification of the construction is highly desired. However, because the door closer device disclosed in Patent reference 1 is desired to have plural components, for example, the sector gear, the cancellation lever, the first close lever, the second close lever and the fail-safe lever on a drive force transmission passage to transmit the drive force of the latch drive motor configuring the actuator to the latch, the number of components of the door closer device may be increased. Accordingly, the structure of the door closer device may be complicated and the door closer device may be upsized. For example, the door closer device disclosed in Patent reference 1 is provided with the fail-safe lever for releasing the engagement of the sector gear and the cancellation lever. Thus, a space for mounting the fail-safe lever and a control means, for example, a control unit or a cable, to operate the fail-safe lever is desired.

A need thus exists for a door closer device for a vehicle which is not susceptible to the drawback mentioned above.

SUMMARY

According to an aspect of this disclosure, a door closer device for a vehicle, the door closer device being mounted to a door of the vehicle includes a latch being rotatable in a first direction in which the latch is configured to be engaged with a striker provided at a vehicle body, the latch being rotatable in a second direction in which the latch is configured to be released from the striker, the latch being configured to be engaged with the striker and rotating in the first direction in response to a closing of the door, a drive force transmission mechanism being configured to transmit a drive force of an actuator to the latch for a closing operation, the closing operation rotating the latch in the first direction from a half-latched position where the latch is configured to be incompletely engaged with the striker to a fully-latched position where the latch is configured to be completely engaged with the striker, and a cancellation mechanism cancelling the closing operation of the drive force transmission mechanism. The drive force transmission mechanism includes a drive force transmission portion, the drive force transmission portion being provided on a drive force transmission passage being configured to be formed between the actuator and the latch, the drive force transmission portion being rotatable between a transmission position where the latch is configured to receive the drive force of the actuator and a non-transmission position where the latch is configured not to receive the drive force of the actuator, the drive force transmission portion being set at the transmission position in response to the closing operation. The cancellation mechanism includes a first operation portion and a second operation portion, the first operation portion being engaged with the drive force transmission portion to be rotated irrespective of the second operation portion, the second operation portion being engaged with the drive force transmission portion to be rotated irrespective of the first operation portion, the first operation portion and the second operation portion rotating the drive force transmission portion from the transmission position to the non-transmission position.

According to another aspect of this disclosure, a door closer device for a vehicle, the door closer device being mounted to a door of the vehicle includes a latch being rotatable in a first direction in which the latch is configured to be engaged with a striker provided at a vehicle body, the latch being rotatable in a second direction in which the latch is configured to be released from the striker, the latch being configured to be engaged with the striker and rotating in the first direction in response to a closing of the door, a pawl being rotatable between a restriction position where a rotation of the latch in the second direction is restricted and a non-restriction position where the rotation of the latch in the second direction is not restricted, a pivot portion rotating the pawl from the restriction position to the non-restriction position, a drive force transmission mechanism being configured to transmit a drive force of an actuator to the latch for a closing operation, the closing operation rotating the latch in the first direction from a half-latched position where the latch is configured to be incompletely engaged with the striker to a fully-latched position where the latch is configured to be completely engaged with the striker, and a cancellation mechanism cancelling the closing operation of the drive force transmission mechanism. The drive force transmission mechanism includes a drive force transmission portion, the drive force transmission portion being provided on a drive force transmission passage being configured to be formed between the actuator and the latch, the drive force transmission portion being rotatable between a transmission position where the latch is configured to receive the drive force of the actuator and a non-transmission position where the latch is configured not to receive the drive force of the actuator, the drive force transmission portion being set at the transmission position in response to the closing operation. The cancellation mechanism includes an operation portion being provided separately from the pivot portion, the operation portion being engaged with the drive force transmission portion to be rotated, the operation portion rotating the drive force transmission portion from the transmission position to the non-transmission position, the operation portion including a coaxial structure in which the operation portion is rotatably supported by a same rotary shaft as the rotary shaft of the drive force transmission portion.

According to further aspect of this disclosure, a door closer device for a vehicle, the door closer device being mounted to a door of the vehicle includes a latch being rotatable in a first direction in which the latch is configured to be engaged with a striker provided at a vehicle body, the latch being rotatable in a second direction in which the latch is configured to be released from the striker, the latch being configured to be engaged with the striker and rotating in the first direction in response to a closing of the door, a pawl being rotatable between a restriction position where a rotation of the latch in the second direction is restricted and a non-restriction position where the rotation of the latch in the second direction is not restricted, a pivot portion rotating the pawl from the restriction position to the non-restriction position, a drive force transmission mechanism being configured to transmit a drive force of an actuator to the latch for a closing operation, the closing operation rotating the latch in the first direction from a half-latched position where the latch is configured to be incompletely engaged with the striker to a fully-latched position where the latch is configured to be completely engaged with the striker, and a cancellation mechanism cancelling the closing operation of the drive force transmission mechanism. The drive force transmission mechanism includes a drive force transmission portion, the drive force transmission portion being provided on a drive force transmission passage being configured to be formed between the actuator and the latch, the drive force transmission portion being rotatable between a transmission position where the latch is configured to receive the drive force of the actuator and a non-transmission position where the latch is configured not to receive the drive force of the actuator, the drive force transmission portion being set at the transmission position in response to the closing operation. The cancellation mechanism includes an operation portion being provided separately from the pivot portion, the operation portion being engaged with the drive force transmission portion to be rotated, the operation portion rotating the drive force transmission portion from the transmission position to the non-transmission position, the operation portion including a rotary shaft extending in a same direction as the rotary shaft of the drive force transmission portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
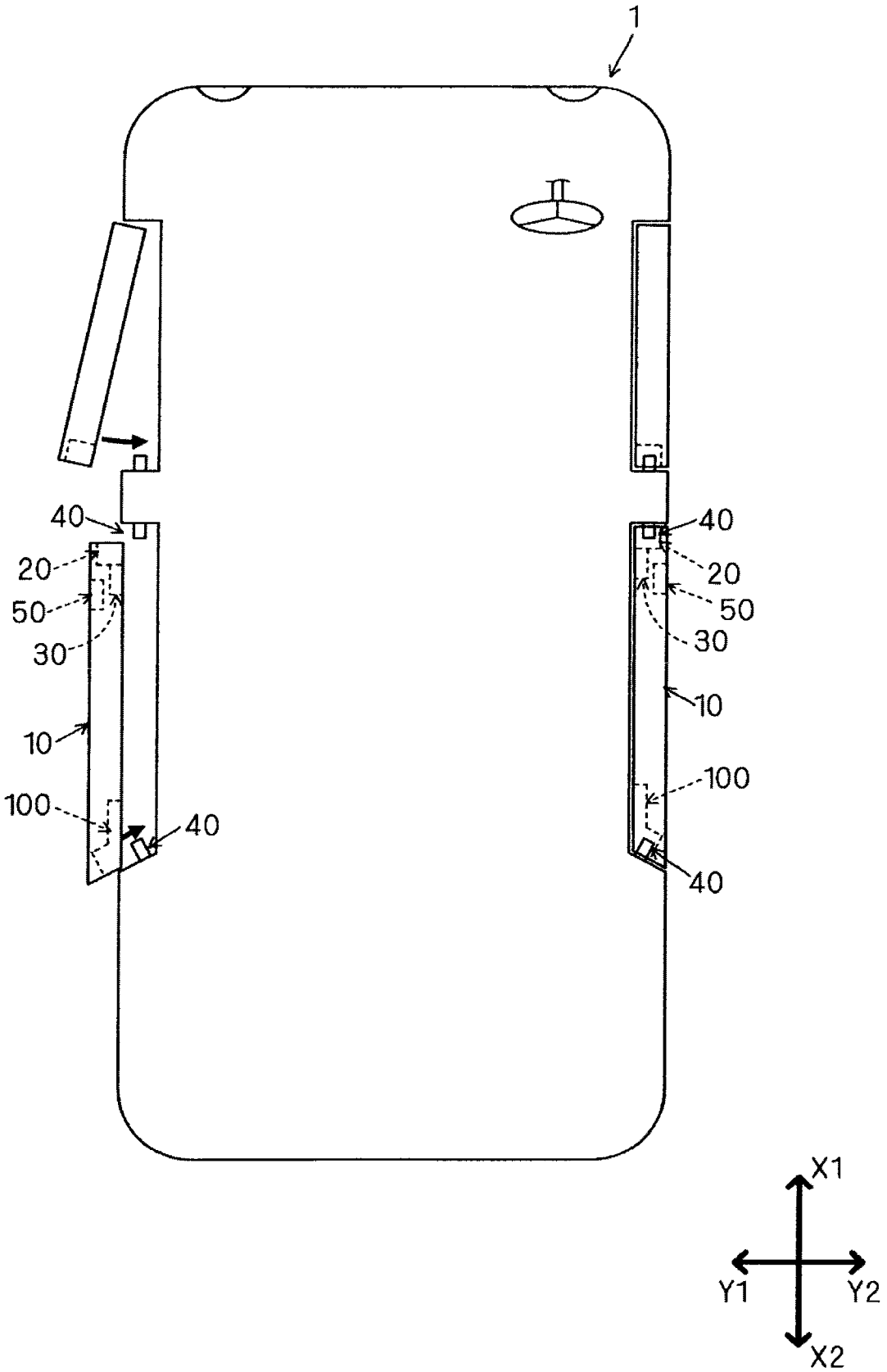
FIG. 1 is a plan view schematically illustrating a construction of a vehicle that is provided with sliding-type doors for the vehicle according to the disclosure disclosed here.

An embodiment of this disclosure will hereunder be explained with reference to the plural drawings. In the drawings, arrows X1, X2 show a frontward direction and a rearward direction of a vehicle, respectively. Arrows Y1, Y2 show a leftward direction and a rightward direction of the vehicle, respectively. Arrows Z1, Z2 show an upward direction and a downward of the vehicle, respectively. A door closer device 100 for the vehicle that is before being mounted to a door of the vehicle or after being mounted to the door of the vehicle may be shown with the aforementioned directions. In the description of this disclosure, a rotation is described as a rotary movement of a predetermined component about a shaft regardless of the operation amount. Alternatively, the rotation may be appropriately described as a pivot, or a swing.

A vehicle 1 shown in FIG. 1 is provided with sliding-type doors 10 for the vehicle 1 that correspond to rear seats of the vehicle 1. The door 10 of the vehicle 1 is operable between a fully-closed state where an entrance for a passenger is fully-closed and a fully-open state where the entrance is opened so as an opening area of the entrance comes to be at a maximum. The door 10 of the vehicle 1 moves diagonally backward from the fully-closed state, and on the way to move diagonally backward, the door 10 of the vehicle 1 moves straightly backward to establish the fully-open state. The door 10 of the vehicle 1 is mounted with a first door-lock device 20, a second door-lock device 30, a remote control device 50 and the door closer device 100 for the vehicle 1 (hereinafter also referred to as the door closer device 100). A striker 40 that corresponds to the first and second door-lock devices 20, 30 and the door closer device 100 is provided at a door frame of a vehicle body.

Figure 2:
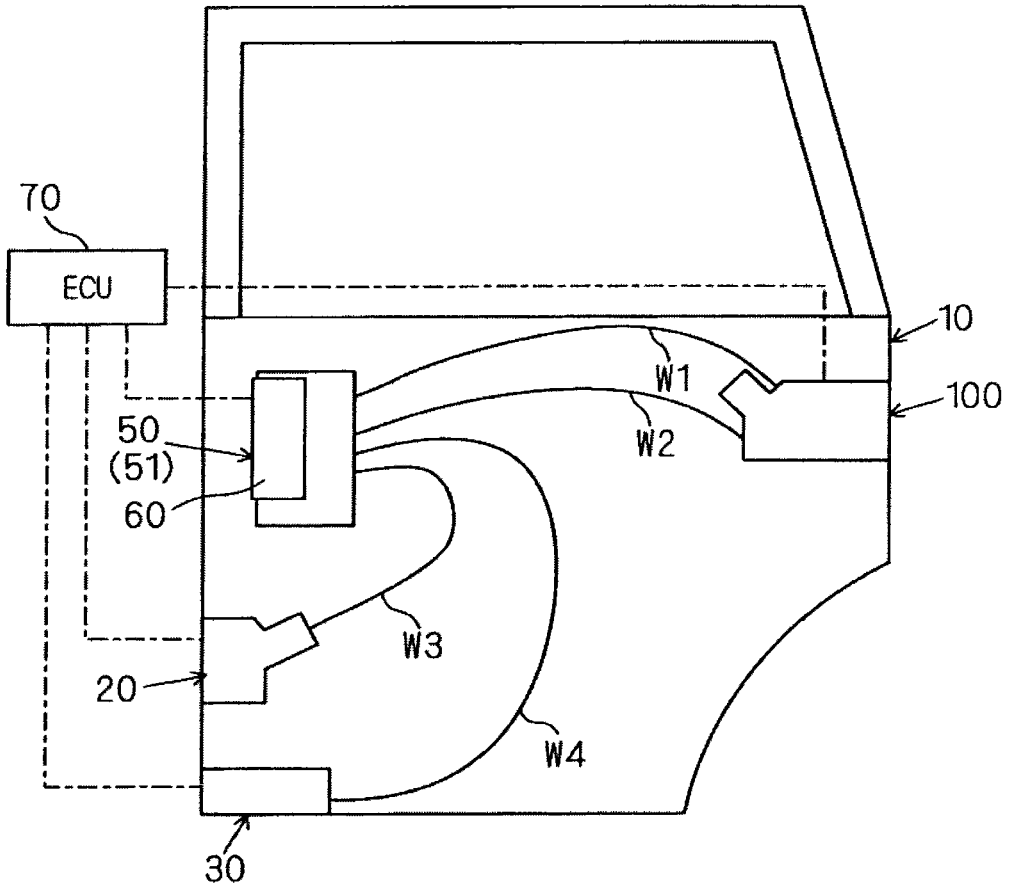
FIG. 2 is a side view schematically illustrating a door of the vehicle shown in FIG. 1.
Figure 2:
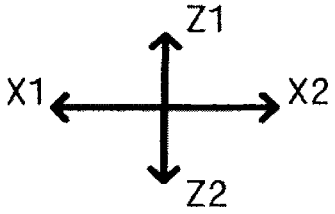

The first door-lock device 20 performs a function that maintains the door 10 of the vehicle 1 in a closed state. As shown in FIG. 2, the first door-lock device 20 is connected to the remote control device 50 via an open cable W3. The second door-lock device 30 performs a function that maintains the door 10 of the vehicle 1 in a fully-open state. As shown in FIG. 2, the second door-lock device 30 is connected to the remote control device 50 via an open cable W4. The structure of the first and second door-lock devices 20, 30 and the remote control device 50 of this disclosure is referred to as the structure of a closing door-lock device 10A, a fully-open door-lock device 10C and a remote control device 91 disclosed in JP2013-163966A.

The door closer device 100 serving as the door closer device 100 for the vehicle 1 of the disclosure is provided with a drive force transmission mechanism 200 and a cancellation mechanism 210. The drive force transmission mechanism 200 performs the closing operation that sets the door 10 of the vehicle 1 being in the half-open state to be in the fully-closed state. The cancellation mechanism 210 cancels the closing operation of the drive force transmission mechanism 200. Here, the half-door state is defined as a state where the door 10 of the vehicle 1 is not completely closed (or opened), or the door 10 of the vehicle 1 is not tightly fixed to the vehicle body. As shown in FIG. 2, the door closer device 100 is connected to the remote control device 50 via a first cable W1 and a second cable W2.

As shown in FIG. 2, the remote control device 50 is connected to, for example, two door handles 60, 60 (i.e., serving as an operation member) that are independently or separately provided at a vehicle inner side and a vehicle outer side, respectively. The door handle 60 provided at the vehicle inner side of the door 10 of the vehicle 1 serves as an inside handle. The door handle 60 provided at the vehicle outer side of the door 10 of the vehicle 1 serves as an outside handle. The remote control device 50 includes a door handle operation detection sensor 51 for detecting the door-opening operation of the door handle 60. In a state where the door 10 of the vehicle 1 is in the unlocked state, that is, in a state where the door-opening operation is not locked, the remote control device 50 pulls the second cable W2, the open cable W3 and an open cable W4 to a side where the remote control device 50 is positioned in conjunction with, or in accordance with the door-opening operation of the door handle 60. On the other hand, in a state where the door 10 of the vehicle 1 is in the locked state, that is, in a state where the door-opening operation is locked, the remote control device 50 prevents the second cable 2 and the open cables W3, W4 from being pulled to the side where the remote control device 50 is positioned in conjunction with, or in accordance with the door-opening operation of the door handle 60.

Figure 3:
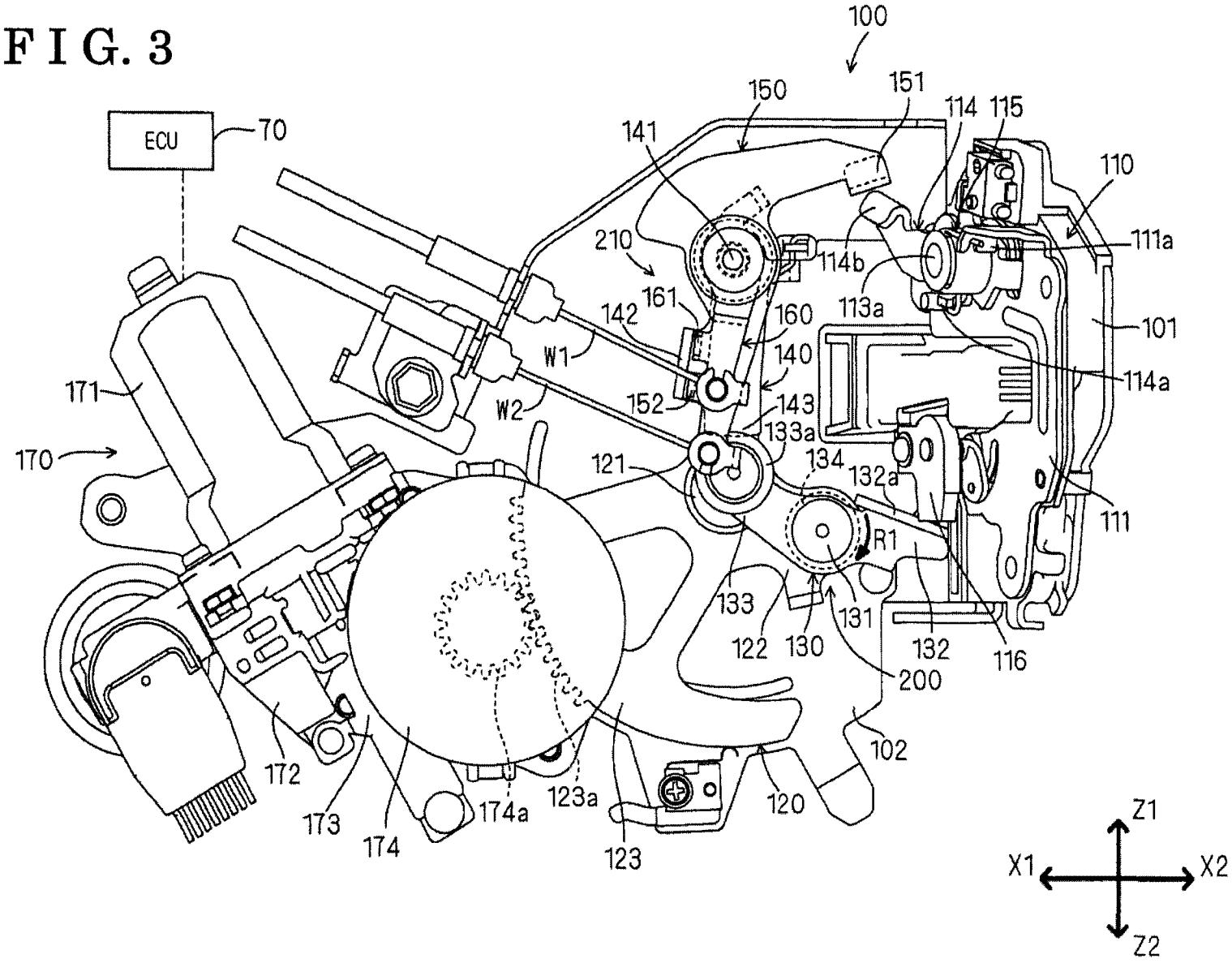
FIG. 3 is a side view illustrating a construction of the door closer device for the vehicle shown in FIG. 2.

As shown in FIG. 3, the door closer device 100 includes a base plate 101 and a connection plate 102. The base plate 101 is provided with a striker receiving groove (see a striker receiving groove 101*a* in FIG. 4) for receiving the striker 40. The connection plate 102 is connected to the base plate 101. A latch mechanism (also referred to as a latch-and-pawl mechanism) 110 is mounted to the base plate 101. The latch mechanism 110 is positioned between the base plate 101 and a latch cover 111.

Figure 4:
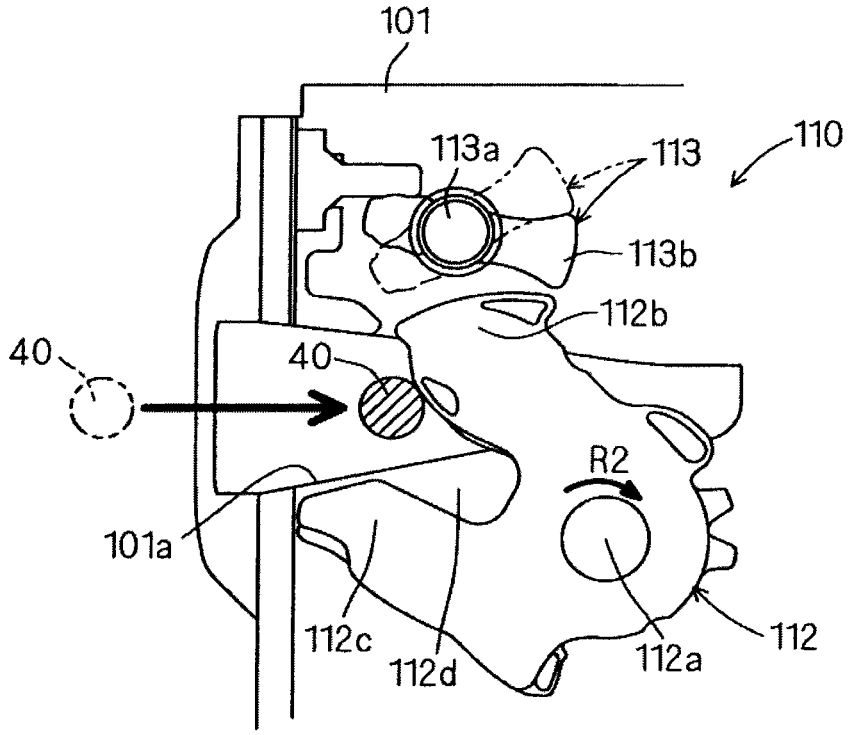
FIG. 4 is a view illustrating a state where a latch of a latch mechanism shown in FIG. 3 is in an unlatched position.

As shown in FIG. 4, the latch mechanism 110 includes a latch 112 and a pawl 113. The latch 112 is covered with the latch cover 111. The pawl 113 includes a rotary shaft 113*a* that extends to and is positioned through the latch cover 111.

Because the latch 112 is rotatably supported by a rotary shaft 112*a* that is provided at the base plate 101, the latch 112 rotates relative to the striker 40 in two directions, a direction in which the latch 112 is engaged with the striker 40 and a direction in which the latch 112 is released from the striker 40. The latch 112 is set at plural positions that are an unlatched position, a fully-latched position, and a half-latched position, the half-latched position being positioned between the unlatched position and the fully-latched position. The latch 112 includes a first retaining pawl 112*b* and a second retaining pawl 112*c* that extend substantially in parallel with each other. An area where the retaining pawls 112*b*, 112*c* face with each other serves as a striker receiving portion 112*d* for receiving the striker 40.

The striker 40 entering into the striker receiving groove 101*a* of the base plate 101 in response to a closing operation of the door 10 of the vehicle 1 enters into the striker receiving portion 112*d* (see an arrow in FIG. 4) while pressing a facing surface of the first retaining pawl 112*b* of the latch 112, the facing surface that faces a striker receiving portion 112*d*. Accordingly, when the door 10 of the vehicle 1 is closed, the latch 112 is engaged with the striker 40 from the unlatched position shown in FIG. 4 to rotate about the rotary shaft 112*a* in the direction in which the latch 112 is engaged with the striker 40 (i.e., serving as a first direction) (a direction shown in an arrow R2 in FIG. 4). That is, the latch 112 rotates in the lock direction in which the latch 112 is more deeply engaged with the striker 40. The latch 112 serves as a latch of this disclosure. The latch 112 is provided with a latch position detection sensor 116. The latch position detection sensor 116 detects the rotary positions of the latch 112, the rotary positions which are the unlatched position, the half-latched position and the fully-latched position.

The pawl 113 is rotatably supported by a rotary shaft 113*a* that is provided at the base plate 101. In this case, the rotary shaft 113*a* of the pawl 113 extends in the same direction or in substantially the same direction as the rotary shaft 112*a* of the latch 112. The pawl 113 rotates between a restriction position and a non-restriction position. The restrict position corresponds to a position where the rotation in the direction in which the striker 40 and the latch 112 are released from each other is restricted. The non-restriction position corresponds to a position where the rotation in the direction in which the striker 40 and the latch 112 are released from each other is not restricted. The pawl 113 serves as a pawl of this disclosure.

As shown in FIG. 3, a pawl drive lever 114 is mounted to the rotary shaft 113*a* of the pawl 113. The pawl drive lever 114 is elastically biased to an initial position by a torsion spring (an elastic coil spring) 115. For this purpose, a first end portion of the torsion spring 115 is retained by a spring engagement portion 111*a* of the latch cover 111. A second end portion of the torsion spring 115 is retained by a spring engagement portion 114*a* of the pawl drive lever 114.

An engaged piece 114*b* of the pawl drive lever 114 is pressed downwardly by an engagement piece 151 of an open lever 150 (i.e., serving as a pivot portion, a first operation portion, a second operation portion). Because the engaged piece 114*b* of the pawl drive lever 114 is pressed downwardly by the engagement piece 151 against the elastic biasing force of the torsion spring 115, the pawl drive lever 114 rotates from the initial position to an operation position. Thus, the pawl 113 is driven from the restriction position (also referred to as the initial position) shown in a solid line in FIG. 4 to the non-restriction position (also referred to as a release position) shown in a two-dot chain line in FIG. 4. When the pawl 113 is positioned at the restriction position, the rotation of the latch 112 in the direction in which the striker 40 and the latch 112 are released from each other is restricted by an engagement piece 113*b*. When the pawl 113 is positioned at the non-restriction position, the rotation of the latch 112 in the direction in which the striker 40 and the latch 112 are released from each other is not restricted.

Figure 5:
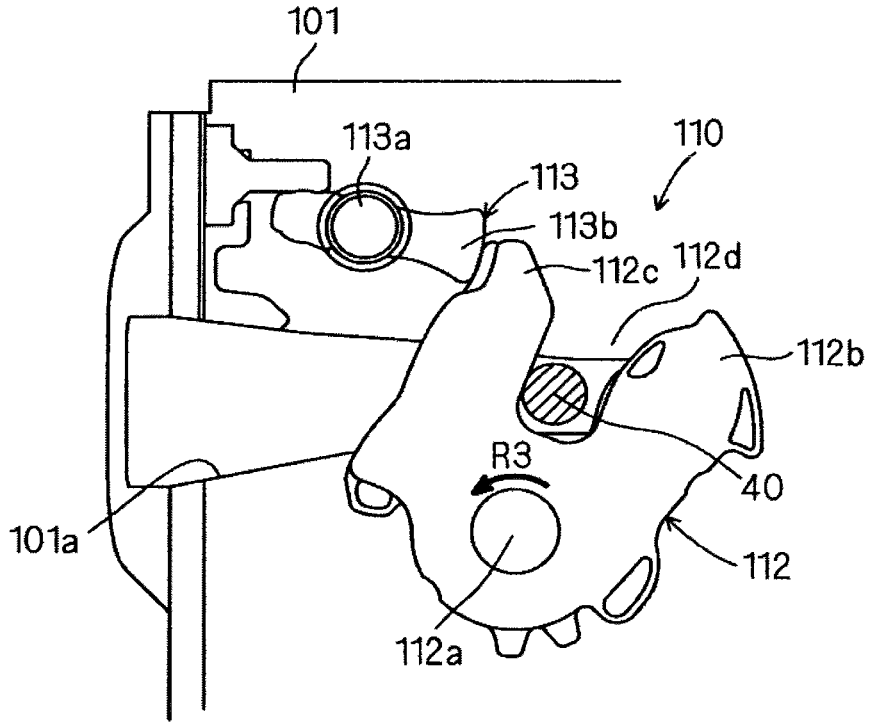
FIG. 5 is a view illustrating a state where the latch of the latch mechanism shown in FIG. 3 is in a fully-latched position.

When the latch 112 rotates about the rotary shaft 112*a* in the clockwise direction from the unlatched position shown in FIG. 4 to the fully-latched position shown in FIG. 5, the latch 112 is positioned at the fully-latched position and is prevented from rotating about the rotary shaft 112*a* in the anti-clockwise direction (i.e., serving as a second direction) (a direction shown in an arrow R3 in FIG. 5) because the second retaining pawl 112*c* of the latch 112 and the engagement piece 113*b* of the pawl 113 come in contact with each other. That is, the latch 112 is prevented from rotating in a releasing direction (the unlatched direction) at the fully-latched position. As a result, the door 10 of the vehicle 1 is maintained in the fully-closed state.

Figure 6:
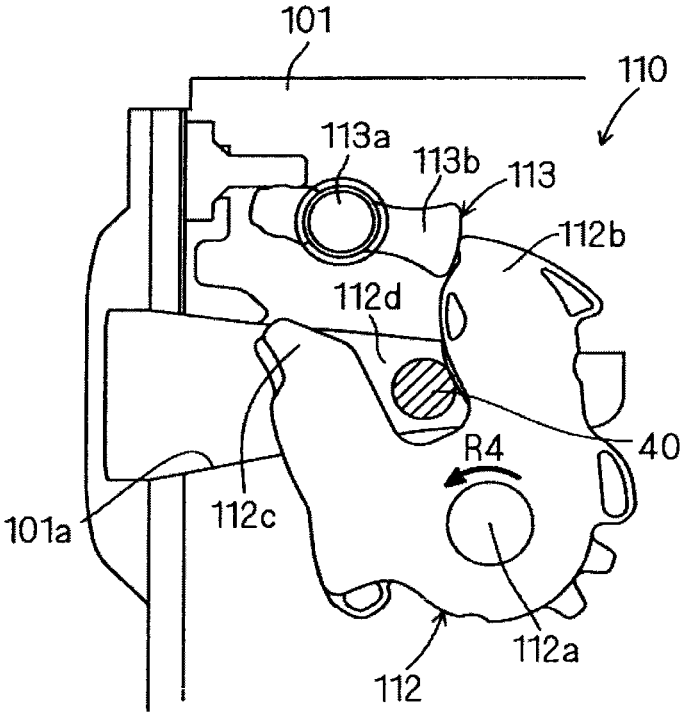
FIG. 6 is a view illustrating a state where the latch of the latch mechanism shown in FIG. 3 is in a half-latched position.

On the other hand, when the latch 112 is stopped at a position before the fully-latched position shown in FIG. 5, that is, when the latch 112 is stopped at the half-latched position shown in FIG. 6, the latch 112 is positioned at the half-latched position and is prevented from rotating about the rotary shaft 112*a* in the anti-clockwise direction (a direction shown in an arrow R4 in FIG. 6). As a result, the door 10 of the vehicle 1 is maintained at a position before the fully-closed position, that is, the door 10 of the vehicle 1 is maintained in a half-closed state.

As shown in FIG. 3, the drive force transmission mechanism 200 transmits the drive force of an actuator 170 to the latch 112 for the closing operation, the closing operation that rotates the latch 112 from the half-latched position where the latch 112 is incompletely engaged with the striker 40 to the fully-latched position where the latch 112 is completely engaged with the striker 40. The drive force transmission mechanism 200 serves as a drive force transmission mechanism of this disclosure. The drive force transmission mechanism 200 is configured by plural rotary drive members that are positioned on the drive force transmission passage, the drive force transmission passage being provided between the actuator 170 and the latch 112. The plural rotary drive members are rotary driven by the actuator 170. The plural rotary drive members include an active lever 120, a passive lever 130 and a first cancellation lever 140 (i.e., serving as a drive force transmission portion). The active lever 120, the passive lever 130 and the first cancellation lever 140 serve as rotary drive members of this disclosure.

The active lever 120 is mounted to the connection plate 102 of the door closer device 100 to be rotatable about the rotary shaft 121. The active lever 120 includes a support piece 122 and a rotary plate 123. The support piece 122 is provided at a side where the latch mechanism 110 is positioned relative to the rotary shaft 121. The rotary plate 123 is provided at a position opposite to the support piece 122 while the rotary plate 123 and the support piece 122 sandwich the rotary shaft 121 therebetween.

The support piece 122 of the active lever 120 rotatably supports the passive lever 130 about a rotary shaft 131. The rotary plate 123 of the active lever 120 is formed in a fan shape or in substantially a fan shape. A gear 123*a* is provided at an outer circumferential rim of the rotary plate 123. The rotary plate 123 is connected to the actuator 170.

The actuator 170 includes an electric latch drive motor 171 and a reduction mechanism 172. The reduction mechanism 172 is driven by the latch drive motor 171. The reduction mechanism 172 is provided with a worm gear 173 and a worm wheel 174. A gear 174*a* being integrally provided with the worm wheel 174 of the reduction mechanism 172 is meshed with a gear 123*a* of the rotary plate 123. Thus, because the latch drive motor 171 is controlled by a known electric control unit (ECU 70) being mounted to the vehicle 1, the rotary speed of a motor shaft of the latch drive motor 171 is reduced by the reduction mechanism 172 and the rotation of the motor shaft of the latch drive motor 171 is transmitted to the rotary plate 123 of the active lever 120. In this case, the active lever 120 can be rotated about the rotary shaft 121 either in the clockwise direction or in the anti-clockwise direction in accordance with the control of the latch drive motor 171.

The ECU 70 includes, for example, a signal processing circuit, a central processing unit (CPU) and a memory circuit. The ECU 70 controls the latch drive motor 171 of the actuator 170 in response to detection signals detected by the door handle operation detection sensor 51 and the latch position detection sensor 116.

The passive lever 130 serves as a driven lever that is passively driven by the active lever 120 serving as a drive lever. The passive lever 130 is formed in a see-saw shape in which two rotary pieces extend in opposing directions while sandwiching the rotary shaft 131. The rotary shaft 131 of the passive lever 130 extends in the same direction or in substantially the same direction (directions along vehicle right-left directions Y1, Y2) as the rotary shaft 121 of the active lever 120. A first rotary piece 132 of the two rotary pieces of the passive lever 130, the first rotary piece 132 being provided at a side where the latch mechanism 110 is positioned is provide with a contact wall 132*a* that is contactable to the latch 112 in FIG. 4. The passive lever 130 is provided with a torsion spring (an elastic coil spring) 134 for elastically biasing the contact wall 132*a* of the first rotary piece 132 in a direction away from the latch 112 in FIG. 4 (a direction shown in an arrow R1 in FIG. 3).

Figure 7:
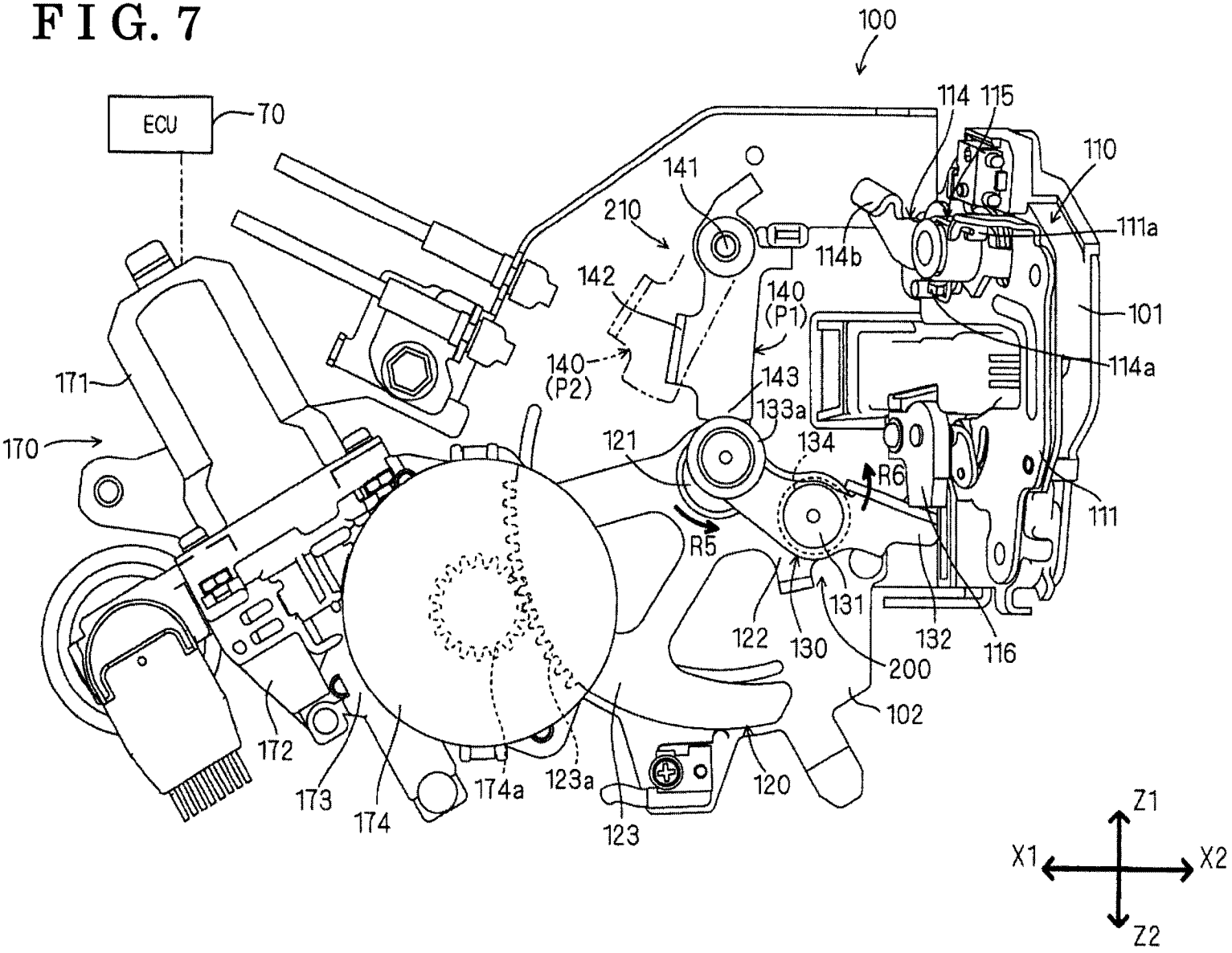
FIG. 7 is a view illustrating a state where an open lever and second cancellation lever shown in FIG. 3 are removed from the cancellation mechanism.

The passive lever 130 includes a contact roller 133*a* that is rotatably supported by a second rotary piece 133 of the two rotary pieces, the second rotary piece 133 being positioned opposite to the latch mechanism 110. The first cancellation lever 140 is provided for the contact roller 133*a* of the second rotary piece 133. As shown in FIG. 7, the first cancellation lever 140 is rotatable between a transmission position P1 (a position shown with the solid line in FIG. 7) where the drive force of the actuator 170 is transmitted to the latch 112 and a non-transmission position P2 (a position shown with the two-dot chain line in FIG. 7) where the drive force of the actuator 170 is not transmitted to the latch 112. When the closing operation of the door 10 of the vehicle 1 is performed, the first cancellation lever 140 is set at the transmission position P1. The first cancellation lever 140 serves as a drive force transmission portion of this disclosure.

In a case where the first cancellation lever 140 is set at the transmission position P1, the contact fell roller 133*a* is positioned because a distal end portion 143 of the first cancellation lever 140 comes in contact with the contact fell roller 133*a* being provided at the second rotary piece 133 of the passive lever 130. Accordingly, in a case where the active lever 120 rotates about the rotary shaft 121 in the anti-clockwise direction (a direction shown in an arrow R5 in FIG. 7) when the distal end portion 143 of the first cancellation lever 140 is positioned at the transmission position P1 where the distal end portion 143 of the first cancellation lever 140 comes in contact with the contact roller 133*a*, the passive lever 130 rotates about the rotary shaft 131 in the anti-clockwise direction (a direction shown in an arrow R6 in FIG. 7) relative to the first cancellation lever 140 against the elastic biasing force of the torsion spring 134, and rotates about the rotary shaft 131 in the anti-clockwise direction relative to the support piece 122 of the active lever 120. As a result, the passive lever 130 moves so as to move the first rotary piece 132 upwardly. In this case, the latch 112 of the latch mechanism 110 is pressed upwardly by the contact wall 132*a* of the first rotary piece 132 of the passive lever 130 to rotate to the fully-latched position shown in FIG. 5. Thus, the door 10 of the vehicle 1 may be moved to the fully-closed position, or may be moved to be in the fully-closed state by the closing operation of the drive force transmission mechanism 200.

On the other hand, in a case where the distal end portion 143 of the first cancellation lever 140 is positioned at the non-transmission position P2 where the distal end portion 143 of the first cancellation lever 140 is away from the contact roller 133*a* of the passive lever 130, the passive lever 130 is independently or separately rotatable relative to the active lever 120. As a result, because the transmission of the drive force transmitted from the active lever 120 to the passive lever 130 is cut off, or is stopped, the latch 112 of the latch mechanism 110 is not pushed upwardly by the contact wall 132*a* of the first rotary piece 132 of the passive lever 130. Accordingly, the latch 112 does not rotate to the fully-latched position shown in FIG. 5. Thus, the closing operation moving the door 10 of the vehicle 1 to the fully-closed state is cancelled by the drive force transmission mechanism 200.

As shown in FIG. 3, the door closer device 100 includes the first cancellation lever 140, the open lever 150 and a second cancellation lever 160 (i.e., serving as a first operation portion, a second operation portion, an operation portion). The cancellation mechanism 210 for cancelling the closing operation of the drive force transmission mechanism 200 is configured with the first cancellation lever 140, the open lever 150 and the second cancellation lever 160. The cancellation mechanism 210 serves as a cancellation mechanism of this disclosure.

A rotary shaft 141 that corresponds to a common rotary shaft of the first cancellation lever 140, the open lever 150 and the second cancellation lever 160 is provided in an upward direction Z1 of the vehicle 1 relative to the rotary shaft 121 of the active lever 120 provided at the connection plate 102 of the door closer device 100. That is, the door closer device 100 includes a coaxial structure in which the first cancellation lever 140, the open lever 150 and the second cancellation lever 160 are rotatably supported by the single rotary shaft 141 that extends along the right-left directions Y1, Y2 of the vehicle 1. Thus, the first cancellation lever 140, the open lever 150 and the second cancellation lever 160 are rotatable about the rotary shaft 141. In the coaxial structure, at least two rotary shafts, or all rotary shafts that rotatably support the first cancellation lever 140, the open lever 150 and the second cancellation lever 160, respectively, extend in the same direction or in substantially the same direction (directions along the right-left directions Y1, Y2 of the vehicle 1). Because the first cancellation lever 140, the open lever 150 and the second cancellation lever 160 use the single rotary shaft 141, the space for mounting the first cancellation lever 140, the open lever 150 and the second cancellation lever 160 may be small, the number of components of the door closer device 100 may be reduced and the door closer device 100 may be downsized.

The common rotary shaft 141 of the first cancellation lever 140, the open lever 150 and the second cancellation lever 160 extends in the same direction or in substantially the same direction (the directions along the right-left directions Y1, Y2 of the vehicle 1) as the rotary shaft 121 of the active lever 120 and of the rotary shaft 131 of the passive lever 130. Accordingly, the number of components that include the rotary shafts extending in the same direction or in substantially the same direction increases in addition to the first cancellation lever 140, the open lever 150 and the second cancellation lever 160. Thus, the space for mounting the components may be downsized.

A portion of the open lever 150, the portion extending downwardly relative to the rotary shaft 141 is connected to a first end portion of the metal-made second cable W2. A second end portion of the second cable W2 is connected to the remote control device 50 shown in FIG. 2. The open lever 150 is elastically biased in the anti-clockwise direction by a torsion spring and is maintained in an initial position shown in FIG. 3. The open lever 150 includes the engagement piece 151 that extends upwardly relative to the rotary shaft 141 and that extends to the engaged piece 114*b* of the pawl drive lever 114. Thus, when the second cable W2 is pulled to the side where the remote control device 50 is positioned, the open lever 150 rotates about the rotary shaft 141 in the clockwise direction against the elastic biasing force of the torsion spring. Accordingly, the engagement piece 151 of the open lever 150 presses the engaged piece 114*b* of the pawl drive lever 114 downwardly. The open lever 150 serves as a pivot portion of this disclosure.

In a case where the door 10 of the vehicle 1 is in the unlocked state where the door-opening operation is not locked, the second cable W2 is pulled to the side where the remote control device 50 is positioned in conjunction with, or in accordance with the door-opening operation of the door handle 60. On the other hand, in a case where the door 10 of the vehicle 1 is in the locked state where the door-opening operation is locked, the second cable W2 is prevented from being pulled to the side where the remote control device 50 is positioned even if the door-opening operation of the door handle 60 is performed. That is, the open lever 150 is not driven when the door 10 of the vehicle 1 is in the locked state while being driven when the door 10 of the vehicle 1 is in the unlocked state.

Figure 8:
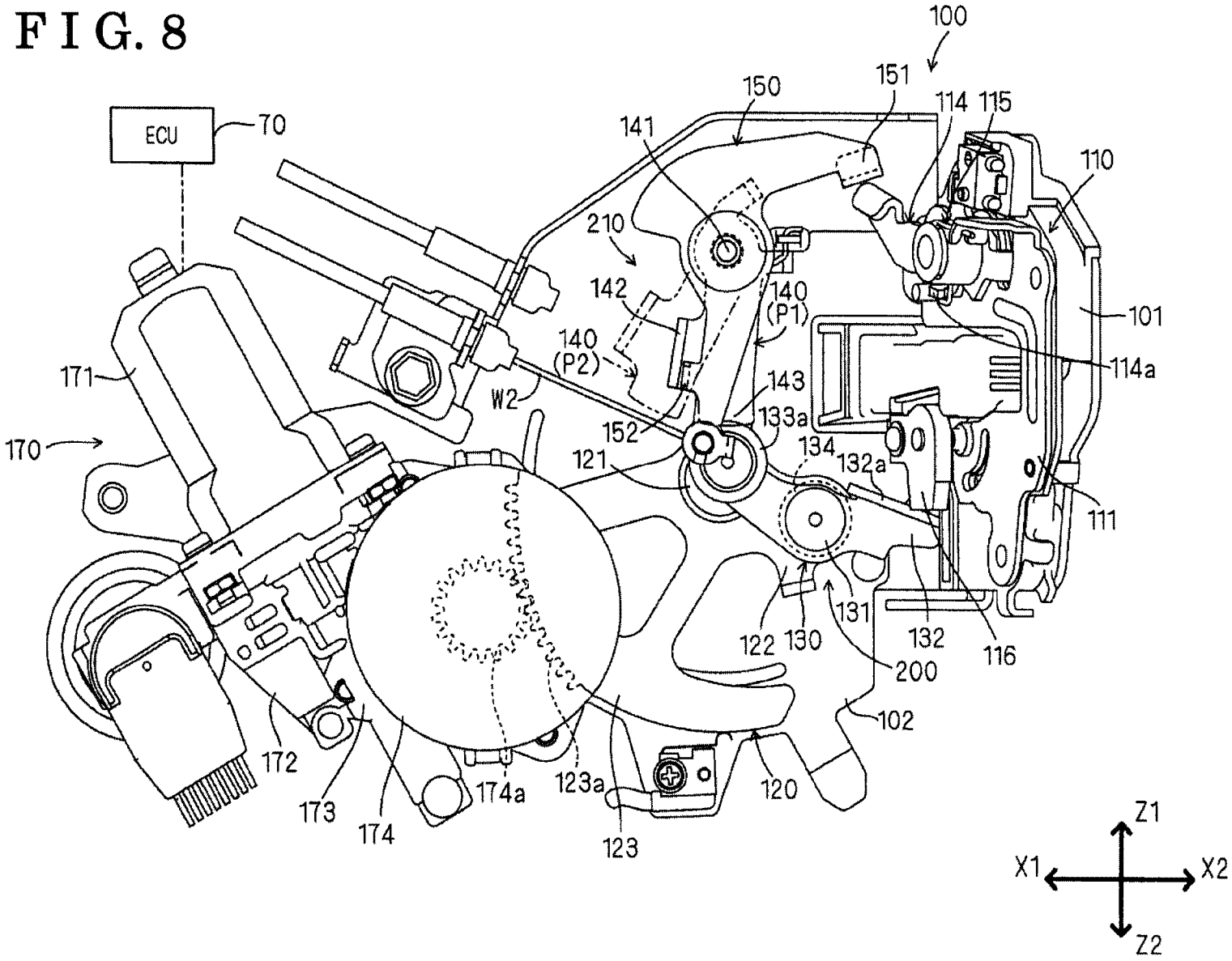
FIG. 8 is a view illustrating a state where the second cancellation lever shown in FIG. 3 is removed from the cancellation mechanism.

As shown in FIG. 8, the first cancellation lever 140 includes a contact piece 142 that is positioned inwardly relative to the open lever 150 and that is positioned to face a contact piece 152 of the open lever 150, the contact piece 152 being provided in a frontward direction X1 of the vehicle 1. Accordingly, when the open lever 150 rotates about the rotary shaft 141 in the clockwise direction, the contact piece 142 of the first cancellation lever 140 is pressed by the contact piece 152 of the open lever 150 to rotate about the rotary shaft 141 in the clockwise direction with the open lever 150. That is, the open lever 150 is engaged with the first cancellation lever 140 irrespective of the second cancellation lever 160 to be rotated about the rotary shaft 141 and rotates the first cancellation lever 140 from the transmission position P1 to the non-transmission position P2. The open lever 150 serves as a first operation portion and a second operation portion of this disclosure. In this case, because the first cancellation lever 140 moves to a position away from the contact roller 133*a* in accordance with, or in response to the rotation of the open lever 150, the transmission of the drive force transmitted from the active lever 120 to the passive lever 130 is cut off, or is stopped. Accordingly, because the latch 112 is not pressed upwardly by the contact wall 132*a* of the first rotary piece 132 of the passive lever 130 and does not move to the fully-latched position shown in FIG. 5, the closing operation of the door 10 of the vehicle 1 by the transmission mechanism 200 is cancelled.

In a state where the door 10 of the vehicle 1 is locked, the open lever 150 does not drive even if the door handle 60 is operated. Accordingly, the closing operation of the door 10 of the vehicle 1 cannot be cancelled by the first cancellation lever 140. Thus, regardless of whether the door 10 of the vehicle 1 is in the unlocked state or is in the locked state, the closing operation of the door 10 of the vehicle 1 cannot be cancelled by the drive force transmission mechanism 200.

Here, as shown in FIG. 3, the cancellation mechanism 210 of this embodiment is provided with the second cancellation lever 160 that includes the same function or substantially the same function as the function of the open lever 150 in addition to the open lever 150 that is provided to drive the first cancellation lever 140. The second cancellation lever 160 includes a portion extending downwardly from the rotary shaft 141 and being connected to a first end of the metal-made first cable W1. A second end of the first cable W1 is connected to the remote control device 50 shown in FIG. 2. The second cancellation lever 160 is overlappingly positioned at the vehicle 1 outer side relative to the first cancellation lever 140. The second cancellation lever 160 is provided with a contact piece 161 that faces a portion of the contact piece 142 of the first cancellation lever 140, the portion positioned in the vehicle rearward direction X2.

It is favorable that the remote control device 50 is provided with a first operation mechanism or a second operation mechanism. The first operation mechanism pulls the first cable W1 to the side where the remote control device 50 is positioned in response to, or in conjunction with the door-opening operation of the door handle 60 regardless of whether the door 10 of the vehicle 1 is in an unlocked state or is in the locked state The second operation mechanism pulls the first cable W1 to the side where the remote control device 50 is positioned in response to, or in conjunction with the door-opening operation of the door handle 60 only when the door 10 of the vehicle 1 is in the locked state.

In the first operation mechanism, when the door-opening operation of the door handle 60 is performed, the second cancellation lever 160 is driven via the first cable W1 regardless of whether the door 10 of the vehicle 1 is in the unlocked state or is in the locked state. That is, according to the first operation mechanism, in a state where the door 10 of the vehicle 1 is unlocked, the open lever 150 and the second cancellation lever 160 are driven when the door handle 60 opens the door 10 of the vehicle 1. In a state where the door 10 of the vehicle 1 is locked, only the second cancellation lever 160 is driven.

In the second operation mechanism, when the door-opening operation of the door handle 60 is performed, the second cancellation lever 160 is driven via the first cable W1 only in a state where the door 10 of the vehicle 1 is locked. That is, according to the second operation mechanism, only the open lever 150 is driven when the door-opening operation of the door handle 60 is performed in a state where the door 10 of the vehicle 1 is unlocked. In a state where the door 10 of the vehicle 1 is locked, only the second cancellation lever 160 is driven when the door-opening operation of the door handle 60 is performed.

Accordingly, because the open lever 150 is not driven when the door-opening operation of the door handle 60 is performed in a state where the door 10 of the vehicle 1 is locked, the second cancellation lever 160 rotates about the rotary shaft 141 in the clockwise direction instead. At this time, the contact piece 142 of the first cancellation lever 140 is pressed by the contact piece 161 of the second cancellation lever 160 to rotate about the rotary shaft 141 in the clockwise direction with the second cancellation lever 160. That is, the second cancellation lever 160 serves as an operation portion that is provided for the first cancellation lever 140 and that is provided irrespective of the open lever 150. The second cancellation lever 160 is engaged with the first cancellation lever 140 irrespective of the open lever 150 to be rotated about the rotary shaft 141 and rotates the first cancellation lever 140 from the transmission position P1 to the non-transmission position P2. The second cancellation lever 160 serves as the first operation portion, the second operation portion and an operation portion of this disclosure. The second cancellation lever 160 serves as the second operation portion for the open lever 150 that serves as the first operation portion. The second cancellation lever 160 serves as the first operation portion for the open lever 150 that serves as the second operation portion. In this case, because the second cancellation lever 160 moves to a position away from the contact roller 133*a* of the passive lever 130 in accordance with the rotation of the first cancellation lever 140, the transmission of the drive force transmitted from the active lever 120 to the passive lever 130 is cut off, or is stopped. Accordingly, even if the open lever 150 is not driven, the closing operation of the door 10 of the vehicle 1 can be cancelled by the drive force transmission mechanism 200 by driving the first cancellation lever 140 via the second cancellation lever 160.

The operations of the first door lock device 20 and of the door closer device 100 in response to the closing operation of the door 10 of the vehicle 1 will hereunder be explained.

As shown in FIG. 1, when the door 10 of the vehicle 1 is closed by the sliding operation, latches of the first door lock device 20 and of the door closer device 100 are engaged with the striker 40. At this time, in a case where the door 10 of the vehicle 1 is closed by the sliding operation with an appropriate strength, the latches of the first door lock device 20 and of the door closer device 100 rotate to the fully-latched position and are engaged with the pawl. As a result, the rotation of the latch in the unlock direction (the unlatched direction) is restricted to maintain the door 10 of the vehicle 1 in the fully-closed state.

On the other hand, in a case where the door 10 of the vehicle 1 is in the half-closed state where the closing operation of the door 10 of the vehicle 1 is disturbed or inhibited because the door 10 of the vehicle 1 is closed with an inappropriate strength, or because the door 10 of the vehicle 1 catches, for example, clothes, the latches of the first door lock device 20 and the door closer device 100 rotate to the half-latched position, the half-latched position before the fully-latched position, and are engaged with the pawl. As a result, the rotation in the unlock position (unlatched position) of the latches are restricted to maintain the door 10 of the vehicle 1 in the half-closed position.

As shown in FIG. 6, according to the door closer device 100, the latch position detection sensor 116 detects that the latch 112 is in the half-latched position. In this case, the ECU 70 controls the latch drive motor 171 of the actuator 170 in response to the detection results. In particular, the ECU 70 controls the rotary direction of the latch drive motor 171 to rotate the active lever 120 in the anti-clockwise direction shown in FIG. 3. In this case, because the contact roller 133*a* of the passive lever 130 is positioned by the first cancellation lever 140, the latch 112 rotates from the half-latched position shown in FIG. 6 to the fully-latched position shown in FIG. 5 by the rotation of the passive lever 130 about the contact roller 133*a* in the anti-clockwise direction. As a result, the door 10 of the vehicle 1 moves from the half-closed position to the fully-closed position to maintain in the fully-closed state.

Here, in a case where the door-opening operation of the door handle 60 is performed on the way that the door 10 of the vehicle 1 moves from the half-closed position (state) to the fully-closed position (state), the cancellation mechanism 210 is driven by one of a first cancellation mode and a second cancellation mode.

Figure 9:
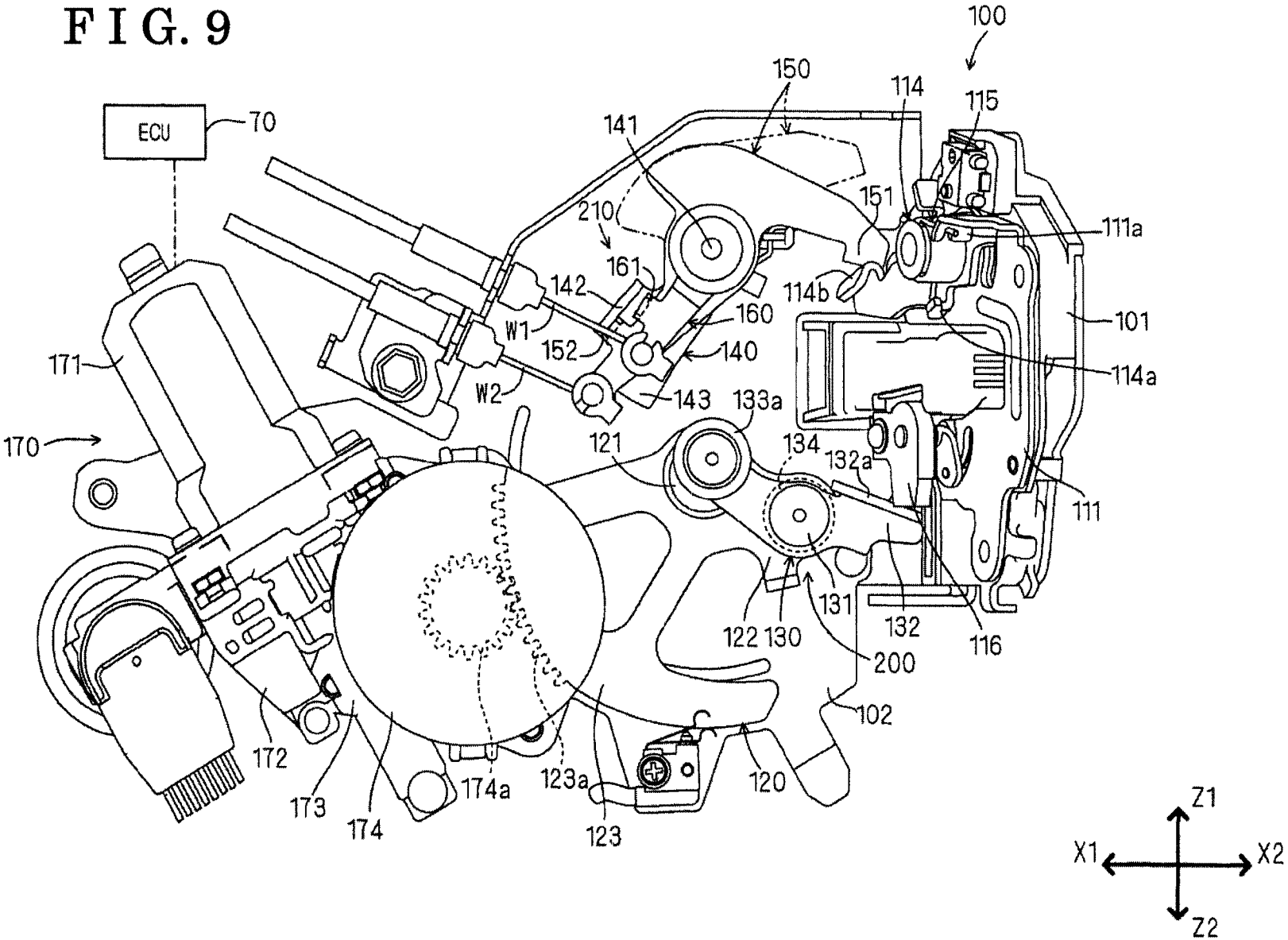
FIG. 9 is a view illustrating a state where the cancellation mechanism shown in FIG. 3 is in a first cancellation mode.

The first cancellation mode serves as an operation mode operated by the cancellation mechanism 210 in a state where the door-opening operation is not locked, that is, in a state where the door 10 of the vehicle 1 is in the unlocked state. As shown in FIG. 9, in the first cancellation mode, the second cable W2 is pulled to the side where the remote control device 50 is positioned in conjunction with, or in accordance with the door-opening operation of the door handle 60. Accordingly, the open lever 150 rotates about the rotary shaft 141 in the anti-clockwise direction. That is, when the door 10 of the vehicle 1 is in the unlocked state, the open lever 150 rotates in conjunction with, or in accordance with the door-opening operation of the door handle 60. In this case, the contact piece 142 of the first cancellation lever 140 is pressed by the contact piece 152 of the open lever 150. Accordingly, the first cancellation lever 140 rotates about the rotary shaft 141 in the clockwise direction with the open lever 150. That is, the first cancellation lever 140 rotates in accordance with the rotation of the open lever 150. Accordingly, because the first cancellation lever 140 comes to be away from the contact roller 133*a* of the passive lever 130, the first cancellation lever 140 is released from the support of the contact roller 133*a*. In this case, because the transmission of the drive force transmitted from the active lever 120 to the passive lever 130 is cut off, or is stopped, the closing operation of the door 10 of the vehicle 1 to move from the half-closed position (the half-closed state) to the fully-closed position (the fully-closed state) can be cancelled (invalidated) by the drive force transmission mechanism 200.

Figure 10:
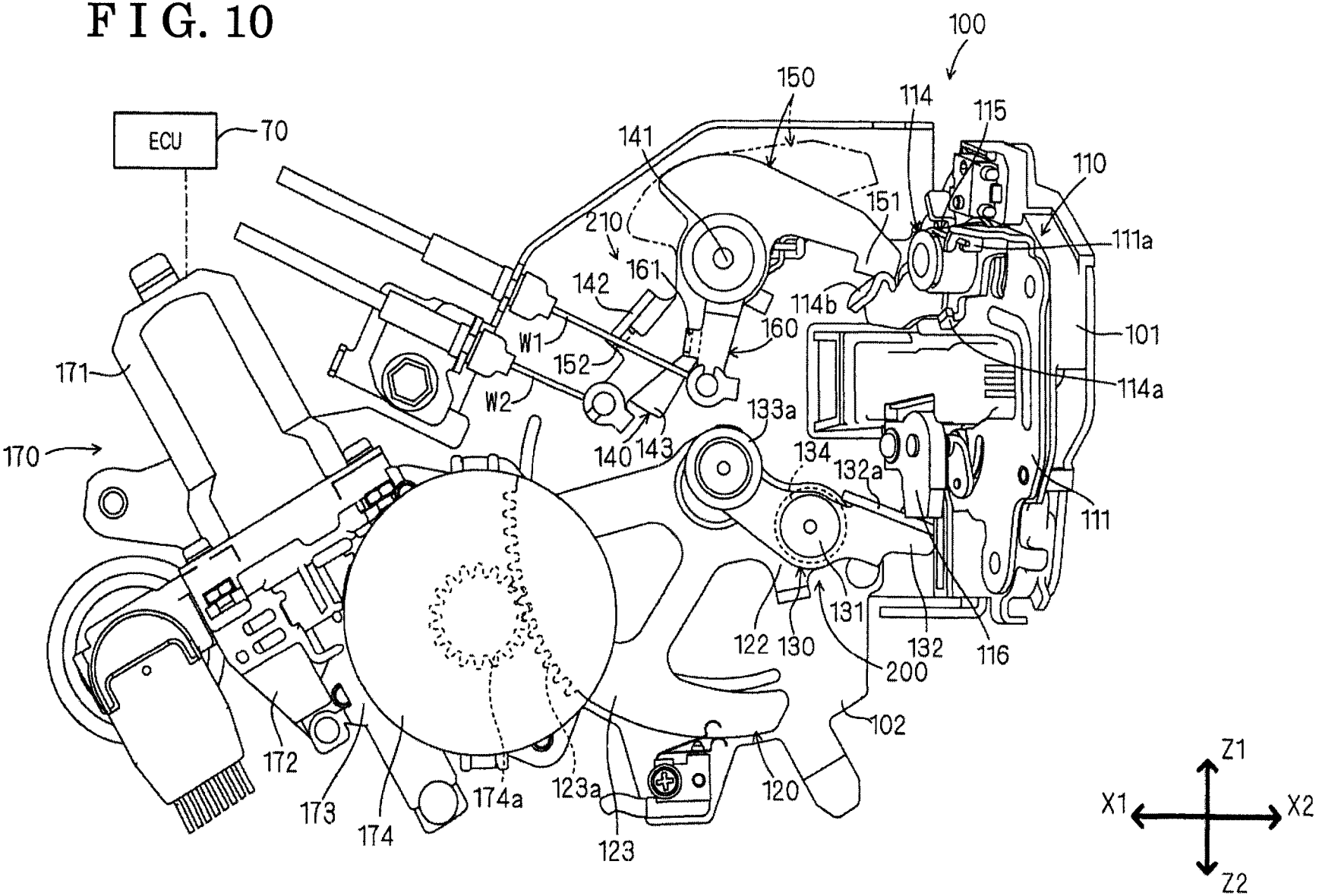
FIG. 10 is a view illustrating a modified example of the first cancellation mode of the cancellation mechanism shown in FIG. 9.

When the open lever 150 rotates about the rotary shaft 141 in the clockwise direction, the second cancellation lever 160 provided for the first cancellation lever 140, the second cancellation lever 160 being provided irrespective of the open lever 150 may rotate in the same direction or in substantially the same direction of the rotation of the open lever 150 as shown in FIG. 9. Alternatively, as shown in FIG. 10, the second cancellation lever 160 can be held at the initial position shown in FIG. 3. Specifically, as shown in FIG. 9, in a state where the door 10 of the vehicle 1 is unlocked, the open lever 150 and the second cancellation lever 160 rotate in conjunction with, or in accordance with the door-opening operation and the door-closing operation of the door handle 60. Alternatively, in spite of the configuration that the open lever 150 and the second cancellation lever 160 rotate (operate) in a state where the door 10 of the vehicle 1 is unlocked, one of the first and second operation portions may rotate in a state where the door 10 of the vehicle 1 is unlocked. The other of the first and second operation portions being not driven in the unlocked state may rotate in a state where the door 10 of the vehicle 1 is locked.

Because the open lever 150 rotates about the rotary axis 141 in the clockwise direction, the engaged piece 114*b* of the pawl drive lever 114 is pressed downwardly by the engagement piece 151 of the open lever 150. Accordingly, the pawl 113 is driven to the non-restriction position where the rotation of the latch 112 in the direction in which the latch 112 is released from the striker 40 is not restricted. Thus, the door 10 of the vehicle 1 may be open easily.

Figure 11:
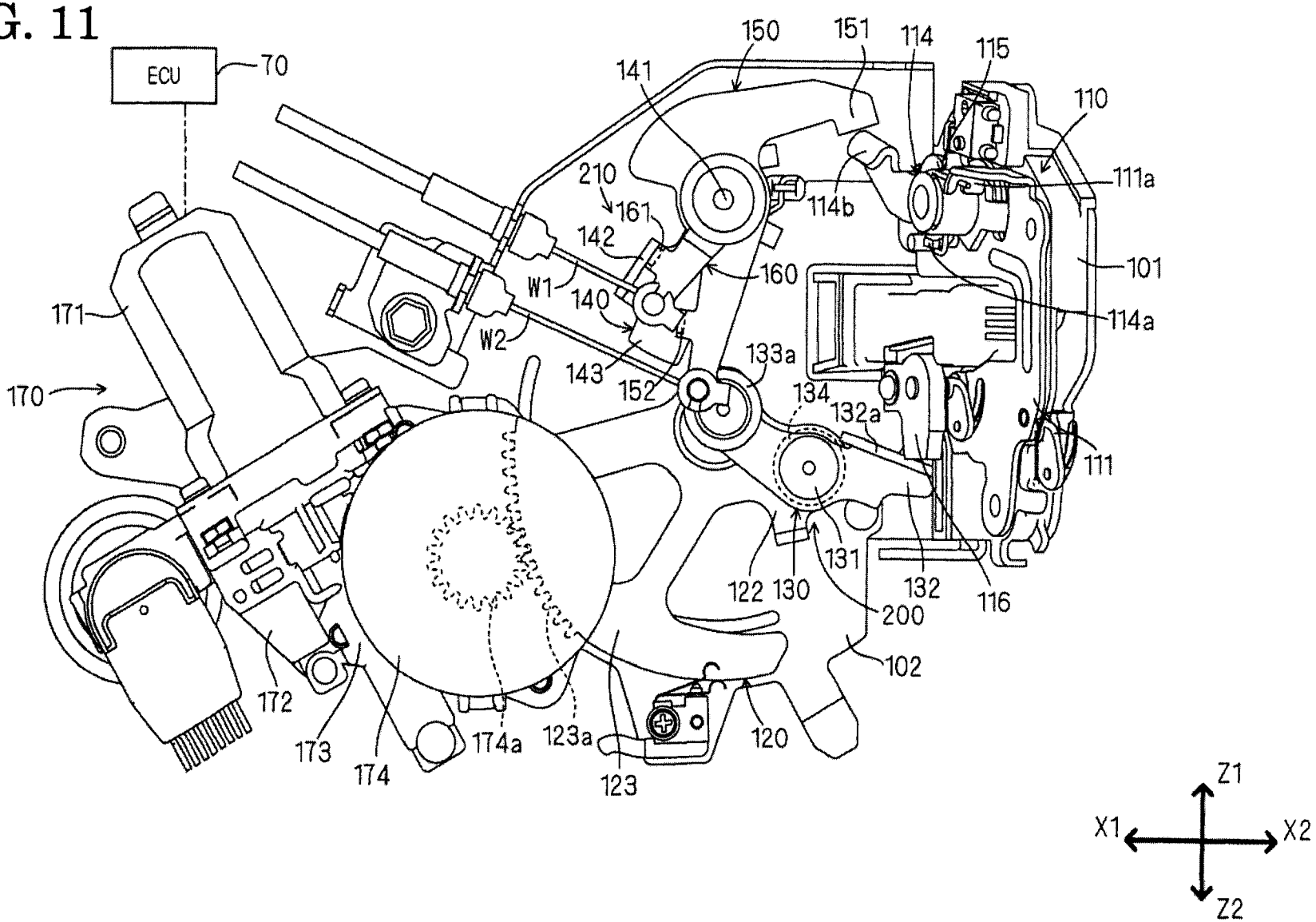
FIG. 11 is a view illustrating a state where the cancellation mechanism shown in FIG. 3 is in a second cancellation mode.

The second cancellation mode serves as an operation mode operated by the cancellation mechanism 210 in a state where the door-opening operation is locked, that is, in a state where the door 10 of the vehicle 1 is in the locked state. As shown in FIG. 11, in the second cancellation mode, the first cable W1 is pulled to the side where the remote control device 50 is positioned in conjunction with, or in accordance with the door-opening operation of the door handle 60. Accordingly, only the second cancellation lever 160 rotates about the rotary shaft 141 in the clockwise direction. That is, when the door 10 of the vehicle 1 is in the locked state, the second cancellation lever 160 rotates in conjunction with, or in accordance with the door-opening operation of the door handle 60. In this case, the contact piece 142 of the first cancellation lever 140 is pressed by the contact piece 161 of the second cancellation lever 160. Accordingly, the first cancellation lever 140 rotates about the rotary shaft 141 in the clockwise direction with the second cancellation lever 160. That is, the first cancellation lever 140 rotates in accordance with the rotation of the second cancellation lever 160. Accordingly, because the first cancellation lever 140 comes to be away from the contact roller 133*a* of the passive lever 130, the first cancellation lever 140 is released from the support of the contact roller 133*a*. In this case, because the transmission of the drive force transmitted from the active lever 120 to the passive lever 130 is cut off, or is stopped, similarly to a case where the open lever 150 is used, the closing operation of the door 10 of the vehicle 1, the closing operation of the drive force transmission mechanism 200 can be cancelled.

As above, according to the door closer device 100 of the embodiment, the cancellation mechanism 210 is configured by the open lever 150 and the second cancellation lever 160. The open lever 150 is engaged with the first cancellation lever 140 of the drive force transmission mechanism 200 irrespective of the second cancellation lever 160. The second cancellation lever 160 is engaged with the first cancellation lever 140 of the drive force transmission mechanism 200 irrespective of the open lever 150. Specifically, the open lever 150 for driving the pawl 113 also serves as the operation portion for the first cancellation lever 140. Accordingly, because the number of the operation portion dedicated for the first cancellation lever 140 is reduced, the structure of the cancellation mechanism 210 may be simplified. Thus, the structure of the door closer device 100 may be simplified. In this case, the number of components of the door closer device 100 may be efficiently reduced or the door closer device 100 can be efficiently downsized.

According to the door closer device 100 of the embodiment, because the open lever 150 and the second cancellation lever 160 that are provided for the first cancellation lever 140 are used selectively, the closing operation of the drive force transmission mechanism 200 may be cancelled by the cancellation mechanism 210 regardless of whether the door 10 of the vehicle 1 is in the unlocked state or is in the locked state. In this case, because the cancellation mechanism 210 adopts a mechanical (physical) structure for a mechanism that cancels, especially, the closing operation, the expense required for the mechanism can be minimized.

This disclosure is not limited to the aforementioned typical embodiment and is susceptible to various applications and modifications. For example, following examples of the embodiment are applicable.

According to the door closer device 100 of the embodiment, two operation portions, the open lever 150 and the second cancellation lever 160, are used to rotate the first cancellation lever 140 from the transmission position to the non-transmission position. Alternatively, at least one of the open lever 150 and the second cancellation lever 160 is provided for the first cancellation lever 140. In this case, the operation portion is not limited to the open lever 150 and the second cancellation lever 160 and is selectable to various operation portions as desired. For example, instead of the second cancellation lever 160, or in addition to the second cancellation lever 160, at least one operation portion other than the open lever 150 may be provided for the first cancellation lever 140.

According to the door closer device 100 of the aforementioned embodiment, the rotary shaft 141 of the first cancellation lever 140, of the open lever 150 and of the second cancellation lever 160 extends in the same direction or in substantially the same direction as the rotary shaft 121 of the active lever 120 and the rotary shaft 131 of the passive lever 130. Alternatively, according to this disclosure, the rotary shaft 141 may extend to a direction other than the extending direction of the rotary shafts 121, 131.

According to the door closer device 100 of the aforementioned embodiment, all of the three levers, the first cancellation lever 140, the open lever 150 and the second cancellation lever 160, include the coaxial structure in which the first cancellation lever 140, the open lever 150 and the second cancellation lever 160 are rotatably supported by the single rotary shaft 141. Alternatively, at least two of the first cancellation lever 140, the open lever 150 and the second cancellation lever 160 may include the coaxial structure in which two of the first cancellation lever 140, the open lever 150 and the second cancellation lever 160 are rotatably supported by the single rotary shaft 140. In the structure where only the second cancellation lever 160, or an operation portion that corresponds to the second cancellation lever 160, is provided for the first cancellation lever 140, the coaxial structure in which the second cancellation lever 160 and the first cancellation lever 140 are rotatably supported by the single rotary shaft 141 may be adopted. According to the coaxial structure, because at least two levers use the single rotary shaft 141, the space for mounting the lever may be downsized. The number of the components of the door closer device 100 may be reduced. The door closer device 100 may be downsized. As a result, the structure of the door closer device 100 for the vehicle 1 may be simplified.

Alternatively, three levers, the first cancellation lever 140, the open lever 150 and the second cancellation lever 160, may be rotatably supported by different rotary shafts. In this case, it is favorable that at least two of the rotary shafts of the first cancellation lever 140, the open lever 150 and the second cancellation lever 160 extend in the same direction or in substantially the same direction. According to the structure in which only the second cancellation lever 160 or the operation portion corresponding to the second cancellation lever 160 is provided for the first cancellation lever 140, the rotary shafts 141 of the two levers (at least two of the first cancellation lever 140, the open lever 150 and the second cancellation lever 160) may extend in the same direction or in substantially the same direction. Accordingly, the space for mounting the lever may be further downsized. The door closer device 100 may be effectively downsized.

According to the aforementioned embodiment, the first cable W1 serves as a cable that operates the cancellation function only, the cancellation function moving the cancellation lever 140 to the cancellation position via the second cancellation lever 160. The second cable W2 serves as a cable that operates both the cancellation function and the opening function, the opening function rotating the pawl 113 to the release the latch 112. Alternatively, according to this disclosure, the functions of the first and second cables W1, W2 may be switched with each other. In particular, the shapes and the positions of the first cancellation lever 140, the open lever 150 and the second cancellation lever 160 may be appropriately changed in order for the first cable W1 to serve as a cable that has the cancellation function and the opening function and in order for the second cable W2 to serve as a cable that has the cancellation function only.

According to the aforementioned embodiment, the open lever 150 and the second cancellation lever 160 rotate in conjunction with, or in accordance with the door-opening operation of the door handle 60 being provided at the door 10 of the vehicle 1. Alternatively, the open lever 150 and the second cancellation lever 160 rotate in conjunction with, or in accordance with the door-opening operation of an operation member being provided at the door 10 of the vehicle 1, the operation member other than the door handle 60.

According to the aforementioned embodiment, the door closer device 100 is mounted to the sliding-type door 10 of the vehicle 1 that corresponds to a vehicle rear seat. Alternatively, the essential structure of the door closer device 100 may be provided at sliding-type vehicle doors that are provided at various portions of the vehicle 1.

The door closer device (100) for the vehicle (1), the door closer device (100) being mounted to the door (10) of the vehicle (1) includes the latch (112) being rotatable in the first direction in which the latch (112) is configured to be engaged with the striker (40) provided at the vehicle body, the latch (112) being rotatable in the second direction in which the latch (112) is configured to be released from the striker (40), the latch (112) being configured to be engaged with the striker (40) and rotating in the first direction in response to the closing of the door (10), the drive force transmission mechanism (200) being configured to transmit the drive force of the actuator (170) to the latch (112) for the closing operation, the closing operation rotating the latch (112) in the first direction from the half-latched position where the latch (112) is configured to be incompletely engaged with the striker (40) to the fully-latched position where the latch (112) is configured to be completely engaged with the striker (40), and the cancellation mechanism (210) cancelling the closing operation of the drive force transmission mechanism (200). The drive force transmission mechanism (200) includes the drive force transmission portion (the first cancellation lever 140), the drive force transmission portion (the first cancellation lever 140) being provided on the drive force transmission passage being configured to be formed between the actuator (170) and the latch (112), the drive force transmission portion (the first cancellation lever 140) being rotatable between the transmission position where the latch (112) is configured to receive the drive force of the actuator (170) and the non-transmission position where the latch (112) is configured not to receive the drive force of the actuator (170), the drive force transmission portion (the first cancellation lever 140) being set at the transmission position in response to the closing operation. The cancellation mechanism (210) includes the first operation portion (the open lever 150, the second cancellation lever 160) and the second operation portion (the open lever 150, the second cancellation lever 160), the first operation portion (the open lever 150, the second cancellation lever 160) being engaged with the drive force transmission portion (the first cancellation lever 140) to be rotated irrespective of the second operation portion (the open lever 150, the second cancellation lever 160), the second operation portion (the open lever 150, the second cancellation lever 160) being engaged with the drive force transmission portion (140) to be rotated irrespective of the first operation portion (the open lever 150, the second cancellation lever 160), the first operation portion (the open lever 150, the second cancellation lever 160) and the second operation portion (the open lever 150, the second cancellation lever 160) rotating the drive force transmission portion (the first cancellation lever 140) from the transmission position to the non-transmission position.

According to the aforementioned construction of the door closer device 100 for the vehicle 1, the cancellation mechanism 210 is provided with the open lever 150 and the second cancellation lever 150, 160. The open lever 150 is engaged with the first cancellation lever 140 of the drive force transmission mechanism 200 irrespective of the second cancellation lever 160. The second cancellation lever 160 is engaged with the first cancellation lever 140 of the drive force transmission mechanism 200 irrespective of the open lever 150. Accordingly, because the structure of the cancellation mechanism 210 can be simplified, the structure of the door closer device 100 for the vehicle 1 can be simplified. In this case, the number of components of the door closer device 100 for the vehicle 1 can be effectively reduced. The door closer device 100 for the vehicle 1 can be effectively downsized.

The door closer device (100) for the vehicle (1) further includes the pawl (113) being rotatable between the restriction position where the rotation of the latch (112) in the second direction is restricted and the non-restriction position where the rotation of the latch (112) in the second direction is not restricted, and the pivot portion (the open lever 150) driving the pawl (113) from the restriction position to the non-restriction portion, the pivot portion (the open lever 150) rotating the drive force transmission portion (the first cancellation lever 140) from the transmission position to the non-transmission position. One of the first operation portion (the open lever 150, the second cancellation lever 160) of the cancellation mechanism (210) and the second operation portion (the open lever 150, the second cancellation lever 160) of the cancellation mechanism (210) is configured by the pivot portion (the open lever 150).

In this case, the operation portion of the cancellation mechanism 210 can be provided by the use of the open lever 150 of the door closer device 100. That is, the open lever 150 also serves as the first operation portion 150, 160 of the cancellation mechanism 210. Accordingly, because the number of the operation portion dedicated for the first cancellation lever 140 is reduced, the structure of the cancellation mechanism 210 can be simplified.

The drive force transmission portion (the first cancellation lever 140), the first operation portion (the open lever 150, the second cancellation lever 160) and the second operation portion (the open lever 150, the second cancellation lever 160) include respective rotary shafts (141), the rotary shafts (141) supporting the drive force transmission portion (the first cancellation lever 140), the first operation portion (the open lever 150, the second cancellation lever 160) and the second operation portion (the open lever 150, the second cancellation lever 160) to be rotatable, respectively. At least two of the rotary shafts (141) extend in the same direction.

Accordingly, the arrangement space for the first cancellation lever 140, the open lever 150 and the second cancellation lever 160 can be reduced.

The at least two of the rotary shafts (141) of the drive force transmission portion (the first cancellation lever 140), the first operation portion (the open lever 150, the second cancellation lever 160) and the second operation portion (the open lever 150, the second cancellation lever 160) extend in the same direction as the rotary shaft (121, 131, 141) supporting a rotary drive member (the active lever 120, the passive lever 130, the first cancellation lever 140) to be rotatable, the rotary drive member (the active lever 120, the passive lever 130, the first cancellation lever 140) being provided on the drive force transmission passage, the rotary drive member (the active lever 120, the passive lever 130, the first cancellation lever 140) being rotary driven by the actuator (170).

Accordingly, because the number of components of the door closer device 100 for the vehicle 1, the components having the rotary shafts that extend in the same direction increases, the arrangement space for positioning the components can be reduced.

At least two of the drive force transmission portion (the first cancellation lever 140), the first operation portion (the open lever 150, the second cancellation lever 160) and the second operation portion (the open lever 150, the second cancellation lever 160) are rotatably supported by the same rotary shaft (141).

In this case, because at least two of the first cancellation lever 140, the open lever 150 and the second cancellation lever 160 use the single rotary shaft 141, the arrangement space of the first cancellation lever 140, the open lever 150 and the second cancellation lever 160 can be reduced. The number of components of the door closer device 100 for the vehicle 1 can be reduced. The door closer device 100 for the vehicle 1 can be downsized.

The drive force transmission portion (the first cancellation lever 140), the first operation portion (the open lever 150, the second cancellation lever 160) and the second operation portion (the open lever 150, the second cancellation lever 160) are rotatably supported by the same rotary shaft (141).

Accordingly, the arrangement space for the first cancellation lever 140, the open lever 150 and the second cancellation lever 160 can be further reduced. The number of components of the door closer device 100 for the vehicle 1 can be further reduced. The door closer device 100 for the vehicle 1 can be further downsized.

In a state where the door (10) is unlocked, the first operation portion (the open lever 150, the second cancellation lever 160) of the cancellation mechanism (210) and the second operation portion (the open lever 150, the second cancellation lever 160) of the cancellation mechanism (210) rotate in conjunction with the door-opening operation of the operation member (the door handle 60), the operation member (the door handle 60) being operated for the opening of the door (10) and the closing of the door (10). In a state where the door (10) is locked, only one of the first operation portion (the open lever 150, the second cancellation lever 160) of the cancellation mechanism (210) and the second operation portion (the open lever 150, the second cancellation lever 160) of the cancellation mechanism (210) rotates in conjunction with the door-opening operation of the operation member (the door handle 60).

In this case, in a state where the door 10 of the vehicle 1 is in an unlocked state, the open lever 150 and the second cancellation lever 160 may be rotated in conjunction with only the door opening operation of the door handle 60. Alternatively, the open lever 150 and the second cancellation lever 160 may be rotated in conjunction with the door opening operation and the door closing operation of the door handle 60. Thus, because the open lever 150 and the second cancellation lever 160 can be used selectively, the closing operation of the drive force transmission mechanism 200 may be cancelled regardless of whether the door 10 of the vehicle 1 is in the unlocked state or is in the locked state.

The door closer device (100) for the vehicle (1), the door closer device (100) being mounted to the door (10) of the vehicle (1) includes the latch (112) being rotatable in the first direction in which the latch (112) is configured to be engaged with the striker (40) provided at the vehicle body, the latch (112) being rotatable in the second direction in which the latch (112) is configured to be released from the striker (40), the latch (112) being configured to be engaged with the striker (40) and rotating in the first direction in response to the closing of the door (10), the pawl (113) being rotatable between the restriction position where the rotation of the latch (112) in the second direction is restricted and the non-restriction position where the rotation of the latch (112) in the second direction is not restricted, the pivot portion (the open lever 150) rotating the pawl (113) from the restriction position to the non-restriction position, the drive force transmission mechanism (200) being configured to transmit the drive force of the actuator (170) to the latch (112) for the closing operation, the closing operation rotating the latch (112) in the first direction from the half-latched position where the latch (112) is configured to be incompletely engaged with the striker (40) to the fully-latched position where the latch (112) is configured to be completely engaged with the striker (40), and the cancellation mechanism (210) cancelling the closing operation of the drive force transmission mechanism (200). The drive force transmission mechanism (200) includes the drive force transmission portion (the first cancellation lever 140), the drive force transmission portion (the first cancellation lever 140) being provided on the drive force transmission passage being configured to be formed between the actuator (170) and the latch (112), the drive force transmission portion (the first cancellation lever 140) being rotatable between the transmission position where the latch (112) is configured to receive the drive force of the actuator (170) and the non-transmission position where the latch (112) is configured not to receive the drive force of the actuator (170), the drive force transmission portion (the first cancellation lever 140) being set at the transmission position in response to the closing operation. The cancellation mechanism (210) includes the operation portion (the second cancellation lever 160) being provided separately from the pivot portion (150), the operation portion (the second cancellation lever 160) being engaged with the drive force transmission portion (the first cancellation lever 140) to be rotated, the operation portion (the second cancellation lever 160) rotating the drive force transmission portion (the first cancellation lever 140) from the transmission position to the non-transmission position, the operation portion (the second cancellation lever 160) including the coaxial structure in which the operation portion (the second cancellation lever 160) is rotatably supported by the same rotary shaft (141) as the rotary shaft (141) of the drive force transmission portion (the first cancellation lever 140).

Because the first cancellation lever 140 of the drive force transmission mechanism 200 and the second cancellation lever 160 have the same rotary shafts 141, the arrangement space for the first cancellation lever 140 and the second cancellation lever 160 can be reduced. The number of components of the door closer device 100 for the vehicle 1 can be reduced. The door closer device 100 for the vehicle 1 can be downsized. As a result, the structure of the door closer device 100 for the vehicle 1 can be simplified.

The door closer device (100) for the vehicle (1), the door closer device (100) being mounted to the door (10) of the vehicle (1) includes the latch (112) being rotatable in the first direction in which the latch (112) is configured to be engaged with the striker (40) provided at the vehicle body, the latch (112) being rotatable in the second direction in which the latch (112) is configured to be released from the striker (40), the latch (112) being configured to be engaged with the striker (40) and rotating in the first direction in response to the closing of the door (10), the pawl (113) being rotatable between the restriction position where the rotation of the latch (112) in the second direction is restricted and the non-restriction position where the rotation of the latch (112) in the second direction is not restricted, the pivot portion (the open lever 150) rotating the pawl (113) from the restriction position to the non-restriction position, the drive force transmission mechanism (200) being configured to transmit the drive force of the actuator (170) to the latch (112) for the closing operation, the closing operation rotating the latch (112) in the first direction from the half-latched position where the latch (112) is configured to be incompletely engaged with the striker (40) to the fully-latched position where the latch (112) is configured to be completely engaged with the striker (40), and the cancellation mechanism (210) cancelling the closing operation of the drive force transmission mechanism (200). The drive force transmission mechanism (200) includes the drive force transmission portion (the first cancellation lever 140), the drive force transmission portion (140) being provided on the drive force transmission passage being configured to be formed between the actuator (170) and the latch (112), the drive force transmission portion (the first cancellation lever 140) being rotatable between the transmission position where the latch (112) is configured to receive the drive force of the actuator (170) and the non-transmission position where the latch (112) is configured not to receive the drive force of the actuator (170), the drive force transmission portion (the first cancellation lever 140) being set at the transmission position in response to the closing operation. The cancellation mechanism (210) includes the operation portion (the second cancellation lever 160) being provided separately from the pivot portion (the open lever 150), the operation portion (the second cancellation lever 160) being engaged with the drive force transmission portion (the first cancellation lever 140) to be rotated, the operation portion (the second cancellation lever 160) rotating the drive force transmission portion (the first cancellation lever 140) from the transmission position to the non-transmission position, the operation portion (the second cancellation lever 160) including the rotary shaft (141) extending in the same direction as the rotary shaft (141) of the drive force transmission portion (the first cancellation lever 140).

According to the door closer device 100 for the vehicle 1, the arrangement space for the first cancellation lever 140 and the second cancellation lever 160 can be reduced. Thus, the door closer device 100 for the vehicle 1 can be downsized.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door closer device for a vehicle, the door closer device being mounted to a door of the vehicle, the door closer device comprising:

a latch being rotatable in a first direction in which the latch is configured to be at least incompletely engaged with a striker provided at a vehicle body of the vehicle, the latch being rotatable in a second direction in which the latch is configured to be released from the striker, the latch being configured to be at least incompletely engaged with the striker and rotating in the first direction in response to a closing of the door;

a drive force transmission mechanism being configured to transmit a drive force of an actuator to the latch for a closing operation, during the closing operation, the drive force transmission mechanism rotates the latch in the first direction from a half-latched position, in which the latch is configured to be incompletely engaged with the striker, to a fully-latched position, in which the latch is configured to be completely engaged with the striker; and a cancellation mechanism cancelling the closing operation of the drive force transmission mechanism; wherein the drive force transmission mechanism includes a drive force transmission portion, the drive force transmission portion being provided on a drive force transmission passage being configured to be formed between the actuator and the latch, the drive force transmission portion being rotatable between a transmission position, in which the latch is configured to receive the drive force of the actuator and a non-transmission position, in which the latch is configured not to receive the drive force of the actuator, the drive force transmission portion being set at the transmission position in during the closing operation; and the cancellation mechanism includes a contact piece of the drive force transmission portion, a first operation portion, and a second operation portion, the first operation portion being engaged with the drive force transmission portion to be rotated irrespective of the second operation portion, the second operation portion being engaged with the drive force transmission portion to be rotated irrespective of the first operation portion, the contact piece of the drive force transmission portion being configured to be independently engaged by each of the first operation portion and the second operation portion such that the drive force transmission portion is independently rotated from the transmission position to the non-transmission position by each of the first operation portion and the second operation portion.

2. The door closer device for the vehicle according to claim 1, further comprising:

a pawl being rotatable between a restriction position, in which a rotation of the latch in the second direction is restricted, and a non-restriction position, in which the rotation of the latch in the second direction is not restricted; wherein the first operation portion drives the pawl from the restriction position to the non-restriction position, the first operation portion rotating the drive force transmission portion from the transmission position to the non-transmission position;

the first operation portion is configured to be a pivot portion.

3. The door closer device for the vehicle according to claim 1, wherein the drive force transmission portion, the first operation portion, and the second operation portion EACH include respective rotary shafts, the rotary shafts supporting the drive force transmission portion, the first operation portion, and the second operation portion to be rotatable, respectively; and at least two of the rotary shafts extend in a same direction.

4. The door closer device for the vehicle according to claim 3, wherein the at least two of the rotary shafts of the drive force transmission portion, the first operation portion, and the second operation portion extend in a same direction as a rotary shaft supporting a rotary drive member to be rotatable, the rotary drive member being provided on the drive force transmission passage, the rotary drive member being configured to be rotary driven by the actuator.

5. The door closer device for the vehicle according to claim 1, wherein at least two of the drive force transmission portion, the first operation portion, and the second operation portion are rotatably supported by the same rotary shaft.

6. The door closer device for the vehicle according to claim 5, wherein the drive force transmission portion, the first operation portion, and the second operation portion are rotatably supported by the same rotary shaft.

7. The door closer device for the vehicle according to claim 1, wherein in a state where the door of the vehicle is unlocked, the first operation portion of the cancellation mechanism and the second operation portion of the cancellation mechanism rotate in conjunction with a door-opening operation of an operation member, the operation member being operated for an opening of the door and the closing of the door; and in a state where the door is locked, the second operation portion of the cancellation mechanism rotates in conjunction with the door-opening operation of the operation member.

* * * * *